US009989339B2

(12) United States Patent
Riess

(10) Patent No.: US 9,989,339 B2
(45) Date of Patent: Jun. 5, 2018

(54) FRAGMENTING PROJECTILE HAVING PROJECTILE CORES MADE OF PB OR PB-FREE MATERIALS HAVING FRAGMENTATION IN STEPS

(71) Applicant: RUAG AMMOTEC GMBH, Fürth (DE)

(72) Inventor: Heinz Riess, Fürth (DE)

(73) Assignee: RUAG AMMOTEC GMBH, Fürth (DE)

( * ) Notice: Subject to any disclaimer, the term of this patent is extended or adjusted under 35 U.S.C. 154(b) by 0 days. days.

(21) Appl. No.: 15/117,140

(22) PCT Filed: Feb. 10, 2015

(86) PCT No.: PCT/EP2015/052780

§ 371 (c)(1),
(2) Date: May 15, 2017

(87) PCT Pub. No.: WO2015/118174

PCT Pub. Date: Aug. 13, 2015

(65) Prior Publication Data

US 2017/0261294 A1 Sep. 14, 2017

(30) Foreign Application Priority Data

Feb. 10, 2014 (DE) ..... 10 2014 001 613

(51) Int. Cl.
*F42B 12/36* (2006.01)
*F42B 5/02* (2006.01)
*F42B 12/02* (2006.01)

(52) U.S. Cl.
CPC ..... *F42B 12/367* (2013.01); *F42B 12/36* (2013.01); *F42B 5/02* (2013.01); *F42B 5/025* (2013.01); *F42B 12/02* (2013.01)

(58) Field of Classification Search
CPC .... F42B 5/00; F42B 5/02; F42B 5/025; F42B 12/02; F42B 12/34; F42B 12/367; F42B 12/74; F42B 30/02; F42B 12/36
(Continued)

(56) References Cited

U.S. PATENT DOCUMENTS 1,632,156 A 6/1927 Wiley
1,650,908 A * 11/1927 Ramsey ..... F42B 12/36 102/430

(Continued)

FOREIGN PATENT DOCUMENTS

DE 10 2007 033662 A1 1/2009

OTHER PUBLICATIONS

International Search Report for PCT/EP2015/052780 dated Apr. 20, 2015; English Translation submitted herewith (7 Pages).

*Primary Examiner* — James S Bergin
(74) *Attorney, Agent, or Firm* — Fitch, Even, Tabin & Flannery LLP

(57) ABSTRACT

The invention relates to fragmenting projectiles. In order that all projectiles of a*waffe*Bug projectile type have the same point of impact, i.e., the same projectile weight, the same center of gravity and the same geometry, and that the marksman can set the fragmentation behavior solely by selecting the projectile, fragmenting projectiles having defined fragmentation in steps for the same point of impact, designed as two projectile types, namely as partially fragmenting projectiles or as jacketed projectiles, are proposed, wherein all fragmenting projectiles of a projectile type have the same projectile weight, the same center of gravity, and the same geometry, a fragmentable core is arranged in the front nose region for both projectile types, all fragmentable cores of a projectile type have the same density and differ from each other in the weight of the fragmentable core depending on the fragmentation, and all projectiles of a
(Continued)

projectile type having the same weight of the fragmentable core have an identical marking that can be seen or felt from the outside.

20 Claims, 2 Drawing Sheets

(58) Field of Classification Search
USPC ..... 102/501, 506–509, 516, 517
See application file for complete search history.

(56) References Cited

U.S. PATENT DOCUMENTS 1,887,324 A * 11/1932 Pocoroba ..... G09F 3/00 102/501
3,230,886 A * 1/1966 Woodring ..... F42B 12/78 102/507
5,400,716 A * 3/1995 Mayer ..... F42B 12/34 102/507
6,209,459 B1 4/2001 Kaufman
6,213,022 B1 4/2001 Pullum
6,546,875 B2 * 4/2003 Vaughn ..... F42B 12/34 102/507
7,509,911 B2 * 3/2009 Muskat ..... F42B 8/16 102/506
8,141,494 B2 * 3/2012 Riess ..... F42B 12/74 102/501
8,578,856 B2 * 11/2013 Riess ..... F42B 12/34 102/506
9,046,333 B2 * 6/2015 Masinelli ..... F42B 12/34
9,500,455 B2 * 11/2016 Riess ..... F42B 12/34
2006/0101691 A1 5/2006 Kinoshita
2010/0224093 A1 * 9/2010 Wilhelm ..... F42B 12/34 102/507
2013/0025490 A1 1/2013 Burczynski
2017/0248395 A1 * 8/2017 Riess ..... F42B 12/34

* cited by examiner

FRAGMENTING PROJECTILE HAVING PROJECTILE CORES MADE OF PB OR PB-FREE MATERIALS HAVING FRAGMENTATION IN STEPS

CROSS-REFERENCE TO RELATED APPLICATIONS

This application is a U.S. national phase application filed under 35 U.S.C. § 371 of International Application No. PCT/EP2015/052780, filed Feb. 10, 2015, designating the United States, which claims priority from German Patent Application No. 10 2014 001 613.7, filed Feb. 10, 2014, which are hereby incorporated herein by reference in their entirety for all purposes.

BACKGROUND OF THE INVENTION

Field of the Invention

The invention relates to fragmenting projectiles having a graduated, defined fragmentation with the same point of impact.

SUMMARY OF THE INVENTION

The invention provides fragmenting projectiles, partially fragmenting projectiles or jacketed projectiles, in which all the projectiles of one type have the same point of impact, that is the same projectile weight, the same center of gravity and the same geometry, and the marksman can determine the fragmentation behavior only by a suitable choice of the projectile.

According to the invention, fragmenting projectiles are achieved having a graduated, defined fragmentation with the same point of impact, designed as two types of projectiles, namely as partial fragmenting projectiles or as jacketed projectiles, wherein all the fragmenting projectiles of one type of projectile have the same projectile weight, the same center of gravity and the same geometry, with a fragmentable core being arranged in the front nose area with both types of projectiles, all fragmentable cores of one type of projectile have the same density and differing from one another in the weight of the fragmentable core, depending on the fragmentation, and all projectiles of one type with the same weight of the fragmentable core have the same marking, which is visible from the outside. The marksman or hunter can select the suitable projectile before shooting and will thus have the desired fragmentation and the same point of impact as all projectiles available for selecting a given type of projectile.

If a high degree of fragmentation is desired, a projectile having a heavier fragmentable core will be selected. Since the weight of the projectile remains the same with all fragmentable cores according to the invention, the weight of the solid non-fragmentable core must be adapted, that is the weight must be lower than that with a lighter fragmentable core.

With the partially fragmentable projectile, a pressed or lathed projectile body is preferably present in the rear area and has a funnel-shaped indentation, on which the fragmentable core sits. This indentation improves the mushroom effect on impact.

With the partially fragmentable projectile, the fragmentable core preferably has the same specific gravity as the projectile body. This improves the point of impact.

With the jacketed projectile-type of projectile, a solid non-fragmentable core is provided in the rear region, so that the fragmentable core sites on the solid non-fragmentable core over the surface area. No indentation in the solid core is necessary here.

With the jacketed projectile-type of projectile, the solid non-fragmentable core and the fragmentable core are preferably made of the same material having the same specific gravity. This improves the point of impact.

In a preferred embodiment, the marking is a colored identification in the region of the ogive of the projectile or the marking is made by plastic tips of different colors placed on the projectile, or the marking consists of manually tactile recesses or elevations. Recesses or elevations have the advantage that they can be felt by a hunter even at night.

The solid or fragmentable core is advantageously made of materials that can be soldered or pressed up to six tons without a shrinkage cavity.

In an advantageous embodiment, the fragmenting projectiles are hunting projectiles. The fragmenting projectiles preferably have a fragmentable core, the weight of which amounts to 25% or 40% or 60% of the weight of the total projectile. These weight ratios have proven to be the best.

In a preferred embodiment, the projectiles in which the weight of the fragmentable core amounts to 25% of the total projectile weight are marked with the color green, the projectiles in which the weight of fragmentable core amounts to 40% of the total projectile weight are marked with the color black, and the projectiles in which the weight of the fragmentable core amounts to 60% of the total projectile weight are marked with the color red.

BRIEF DESCRIPTION OF THE DRAWINGS

The invention is explained in greater detail below with reference to FIGS. 1 and 2 which illustrate embodiments of the invention.

DETAILED DESCRIPTION OF THE INVENTION

Figure 1:
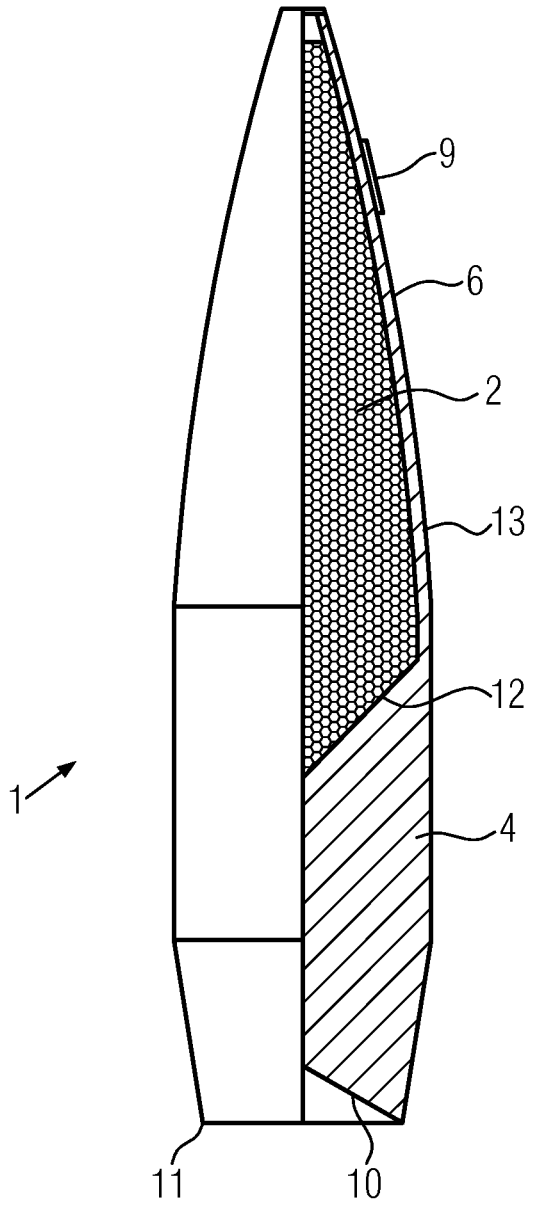

FIG. 1 shows a fragmenting projectile according to the invention, which is considered to be a projectile which is a partial fragmenting projectile 1. A pressed or lathed projectile body 4 is situated in the rear of this partial fragmenting projectile 1. The base 11 of the projectile body has a funnel-shaped rear indentation 10. The projectile body 4 also has a funnel-shaped core indentation 12 on its end facing the tip of the projectile, with a fragmentable core 2 sitting on the funnel-shaped core indentation. A jacket 13 encloses the fragmentable core 2. Reference numeral 6 denotes the ogive of the projectile. According to the invention, a mark, which is visible or tangible from the outside, is provided on the ogive 6 of the projectile. This mark 9 is only indicated schematically in FIG. 1 and also in FIG. 2. This mark 9 is used to identify all of the fragmentable cores 2 of one type of projectile having the same density but differing from in the weight of the fragmentable core 2, depending on the fragmentation.

All of the projectiles of one type of projectile with the same weight of the fragmentable core 2 have the same marking 9. The individual partially fragmenting projectiles 1 all have the same projectile weight, the same center of gravity and the same geometry. All partially fragmenting projectiles 1 have a fragmentable core 2 in the nose area. The term fragmentable core 2 means that it fragments into small individual parts on impact with a target. All fragmentable cores 2 of one type of projectile, that is all of the partially fragmentable projectiles 1 here, have the same density and differ from one another in the weight of the fragmentable core 2, depending on the desired fragmentation. With this partially fragmenting projectile 1, a hunter will know that they will all have the same point of impact, that is they will behave the same and the hunter can determine the degree of fragmentation in selecting the projectile. Since all fragmentation rates are characterized by the same mark 9, this choice is simplified.

Figure 2:
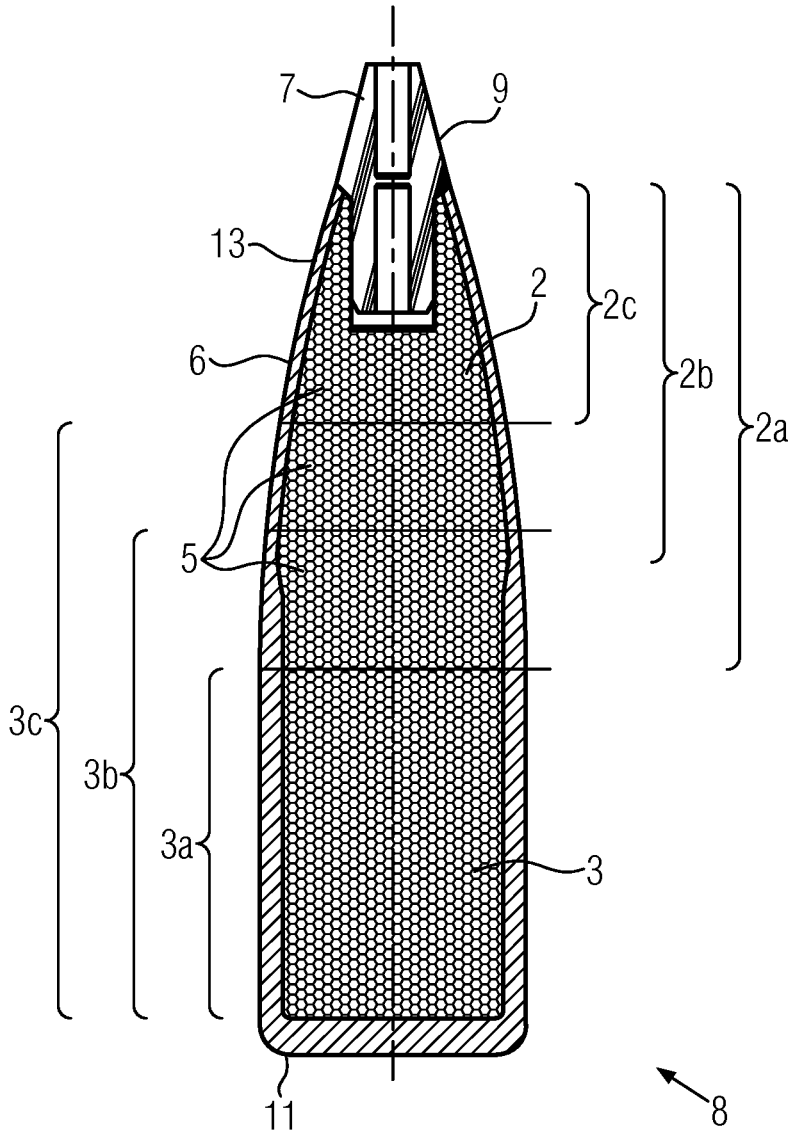

FIG. 2 shows another fragmenting projectile, namely a projectile of the type of the jacketed projectile 8. A solid core 3 is situated in the rear of the projectile with a fragmenting core 2 arranged thereon, sitting on the surface of the solid core 3. A jacket 13 encompasses the solid core 3 and the fragmenting core 2. A mark is applied here by a plastic tip 7 of a different color placed on the projectile.

FIG. 2 shows a different graduated fragmentation 5. If a jacketed projectile, in which the weight of the fragmenting core 2 is 25%, is required, then the fragmenting core 2*c* is combined with the solid core 3*c*. Since the solid core 3*c* and the fragmenting core 2*c* have the same density, the point of impact remains constant. The plastic tip 7 is colored green.

If a jacketed projectile, in which the weight of the fragmenting core 2 is 40%, is required, then the fragmenting core 2*b* is combined with the solid core 3*b*. Since the solid core 3*b* and the fragmenting core 2*b* have the same density, the point of impact remains constant. The plastic tip 7 is colored black.

If a jacketed projectile, in which the weight of the fragmenting core 2 is 60%, is required, then the fragmenting core 2*a* is combined with a solid core 3*a*. Since the solid core 3*a* and the fragmenting core 2*a* have the same density, the point of impact remains constant. The plastic tip 7 is colored red.

The invention thus includes a partially fragmenting projectile 1. The projectile body 4 may be a pressed or lathed projectile body having a fragmentable front core 2. The invention also includes a jacketed projectile 8 having two cores, one solid core 3 in the rear area and a fragmentable core 2 in the front area of the projectile. With both types of projectiles, the same or different materials with the same density may be used for the projectile cores. The different graduated fragmentation 5 is achieved by weight gradations in the fragmentable core 2 at the same projectile weight, center of gravity and geometry. This results in a graduated fragmentation with the same point of impact. The individual types of projectiles can be identified by a colored identification in the region of the ogive 6 of the projectile (FIG. 1) or with attached plastic tips 7 of the different colors (FIG. 2). For night-time use, the individual types of projectiles can be provided with marks in the region of the ogive 6 of the projectile, depending on the fragmentation of the projectile, such that these marks consist of recesses or elevations that can be perceived by the human hand.

Description of the Projectile Cores

The material of the cores may consist of lead-free materials, which can be soldered or pressed up to six tons without shrinkage cavities.

In the case of a projectile having a pressed projectile body 4, the fragmenting core 2 in the front region of the projectile must have the same specific gravity as the pressed projectile body 4.

For the jacketed projectile having two cores, the rear solid core 3 may consist of different materials with the same density as the front fragmentable core 2 but the same material and the same specific gravity are advantageous.

Mechanism of Action of the Projectile

Fragmentation of a projectile in the target body, in particular a hunting projectile in the body of a wild animal after penetration into same, determines the energy released by the projectile and thus the effect of the shot. In the case of a weak animal, for example, a different fragmentation may be necessary than in the case of a strong animal. Both a partially jacketed projectile with a pressed base body and a jacketed projectile whose projectile core or cores are made up of a solid core and a fragmentable core may be used.

The front fragmentable projectile core held by the pressed base body or projectile jacket fragments with the projectile jacket as far as the solid core on impact in the target body. The percentage amount of the fragmentable core of the total weight of the projectile determines the energy released in the target body with the same point of impact over the total distance of the shot despite different fragmentation ratios from one shot to the next. The hunter here has the opportunity of selecting the best fragmentation ratio for the animal to be shot and the distance of the shot.

EXAMPLES

| | | |
|---|---|---|
| 25% | projectile fragmentation | Roe deer |
| | short distance | Fallow deer |
| 40% | short distance | Fallow deer |
| | | Red deer |
| | | Battue |
| 60% | long distance | Fallow deer |
| | | Red deer |
| | | Mountain deer |
| | | Battue |

The invention claimed is:

1. A projectile system having two types of fragmenting projectiles which are a first partially fragmenting type and a second jacketed type wherein:

all projectiles of each type have an identical projectile weight, center of gravity, and geometry, the first and second types each have a fragmentable core disposed at a front part of the projectile, all of the fragmentable cores of each type have an identical density and differ according to type from one and another in weight of the fragmentable core depending on fragmentation of the core, and all projectiles of the first type and of the second type respectively, having the same weight of fragmentable core, have an identical marking visible from outside the projectile or is tactilely sensible identically from outside the projectile.

2. The system according to claim 1, wherein the partially fragmenting types of projectile include a pressed or lathed body disposed in a rear region of the projectile and a funnel-shape on which the fragmentable core sits.

3. The system according to claim 2, wherein the fragmenting core and projectile body have an identical specific gravity.

4. The system according to claim 3, wherein the identical marking is a colored identification in a region of a tip of the projectile or the identical marking is a plastic tip which has a delectable color or the identical marking consists of tactilely sensible recesses or elevations which are perceivable by touching of a human hand.

5. The system of according to claim 3, wherein the fragmentable core comprises material that is solderable or may be pressed up to 6 tons without shrinkage cavities.

6. The system according to claim 2, wherein the identical marking is a colored identification in a region of a tip of the projectile or the identical marking is a plastic tip which has a delectable color or the identical marking consists of tactilely sensible recesses or elevations which are perceivable by touching of a human hand.

7. The system of according to claim 2, wherein the fragmentable core comprises material that is solderable or may be pressed up to 6 tons without shrinkage cavities.

8. The system of according to claim 1, wherein the jacketed projectile includes a solid non-fragmenting core located in a rear part of the jacketed projectile and the fragmentable core sits on an interior surface of the solid non-fragmenting core.

9. The system of according to claim 8, wherein the solid non-fragmentable core and the fragmentable core have an identical specific gravity.

10. The system according to claim 9, wherein the identical marking is a colored identification in a region of a tip of the projectile or the identical marking is a plastic tip which has a delectable color or the identical marking consists of tactilely sensible recesses or elevations which are perceivable by touching of a human hand.

11. The system of according to claim 9, wherein the fragmentable core comprises material that is solderable or may be pressed up to 6 tons without shrinkage cavities.

12. The system according to claim 8, wherein the identical marking is a colored identification in a region of a tip of the projectile or the identical marking is a plastic tip which has a delectable color or the identical marking consists of tactilely sensible recesses or elevations which are perceivable by touching of a human hand.

13. The system of according to claim 8, wherein the fragmentable core comprises material that is solderable or may be pressed up to 6 tons without shrinkage cavities.

14. The system according to claim 1, wherein the identical marking is a colored identification in a region of a tip of the projectile or the identical marking is a plastic tip which has a selectable color or the identical marking consists of tactilely sensible recesses or elevations which are perceivable by touching of a human hand.

15. The system of according to claim 1, wherein the fragmentable core comprises material that is solderable or may be pressed up to 6 tons without shrinkage cavities.

16. The system according to claim 1, wherein the fragmentable core ranges in weight between 25 and 60% of a total weight of the projectile.

17. The system according to claim 16, wherein projectiles in which a weight of the core is 25% of a total weight of the projectiles, are marked with the color green, projectiles in which a weight of the core is 40% of a total weight of the projectiles, are marked with the color black and projectiles in which a weight of the core of the projectiles is 60% of a total weight of the projectiles are marked with the color red.

18. The system according to claim 1, wherein the fragmentable core ranges in weight between 40 and 60% of a total weight of the projectile.

19. The system according to claim 18, wherein projectiles in which a weight of the core is 25% of a total weight of the projectiles, are marked with the color green, projectiles in which a weight of the core is 40% of a total weight of the projectiles, are marked with the color black and projectiles in which a weight of the core of the projectiles is 60% of a total weight of the projectiles are marked with the color red.

20. The system according to claim 1, wherein the fragmenting projectiles are hunting projectiles.

* * * * *